US009273540B2

(12) United States Patent
Nikiforuk

(10) Patent No.: US 9,273,540 B2
(45) Date of Patent: Mar. 1, 2016

(54) DOWNHOLE SLOT CUTTER

(71) Applicant: TESCO CORPORATION, Houston, TX (US)

(72) Inventor: Kevin James Nikiforuk, Houston, TX (US)

(73) Assignee: TESCO CORPORATION, Houston, TX (US)

( * ) Notice: Subject to any disclaimer, the term of this patent is extended or adjusted under 35 U.S.C. 154(b) by 454 days.

(21) Appl. No.: 13/728,652

(22) Filed: Dec. 27, 2012

(65) Prior Publication Data

US 2014/0182853 A1 Jul. 3, 2014

(51) Int. Cl.
*E21B 43/112* (2006.01)

(52) U.S. Cl.
CPC ..... *E21B 43/112* (2013.01)

(58) Field of Classification Search
CPC ..... E21B 29/00; E21B 29/08; E21B 43/112
See application file for complete search history.

(56) References Cited

U.S. PATENT DOCUMENTS

| | | | | |
|---|---|---|---|---|
| 1,015,432 | A | 1/1912 | Frederickson | |
| 1,878,260 | A * | 9/1932 | Bunker | 175/269 |
| 2,108,172 | A | 2/1938 | Margrave | |
| 2,638,165 | A | 5/1953 | Barber | |
| 3,844,347 | A * | 10/1974 | Stotzel et al. | 166/227 |
| 2009/0250220 | A1 * | 10/2009 | Stamoulis | 166/298 |

OTHER PUBLICATIONS

Cutting & Puncturing, USA Industries, Inc. 2003. www.usaindustries.com/Cutting_and_Puncturing.php.
International Search Report & Written Opinion for International Application No. PCT/US2013/075816 mailed Oct. 27, 2014.

* cited by examiner

*Primary Examiner* — William P Neuder
(74) *Attorney, Agent, or Firm* — Fletcher Yoder, P.C.

(57) ABSTRACT

Embodiments of the present disclosure are directed towards a downhole slot cutter. The downhole slot cutter a housing of the downhole slot cutter configured to be inserted into a tubular positioned within a wellbore, and a plurality of dies supported by the housing, wherein the plurality of dies is configured to extend radially outward from the housing.

19 Claims, 4 Drawing Sheets

DOWNHOLE SLOT CUTTER

FIELD OF DISCLOSURE

The present disclosure relates generally to the field of well drilling operations. More specifically, embodiments of the present disclosure relate to a slot cutter for use with down-hole components in a down-hole environment.

BACKGROUND

In conventional oil and gas operations, a well is typically drilled to a desired depth with a drill string, which includes drill pipe and a drilling bottom hole assembly (BHA). Once the desired depth is reached, the drill string is removed from the hole and casing is run into the vacant hole. In some conventional operations, the casing may be installed as part of the drilling process. A technique that involves running casing at the same time the well is being drilled may be referred to as "casing-while-drilling."

Casing may be defined as pipe or tubular that is placed in a well to prevent the well from caving in, to contain fluids, and to assist with efficient extraction of product. When the casing is properly positioned within a hole or well, the casing is typically cemented in place by pumping cement through the casing and into an annulus formed between the casing and the hole (e.g., a wellbore or parent casing). Once a casing string has been positioned and cemented in place or installed, the process may be repeated via the now installed casing string. For example, the well may be drilled further by passing a drilling BHA through the installed casing string and drilling. Further, additional casing strings may be subsequently passed through the installed casing string (during or after drilling) for installation. Indeed, numerous levels of casing may be employed in a well. For example, once a first string of casing is in place, the well may be drilled further and another string of casing (an inner string of casing) with an outside diameter that is accommodated by the inside diameter of the previously installed casing may be run through the existing casing. Additional strings of casing may be added in this manner such that numerous concentric strings of casing are positioned in the well, and such that each inner string of casing extends deeper than the previously installed casing or parent casing string.

Liner may also be employed in some drilling operations. Liner may be defined as a string of pipe or tubular that is used to case open hole below existing casing. Casing is generally considered to extend all the way back to a wellhead assembly at the surface. In contrast, a liner merely extends a certain distance (e.g., 30 meters) into the previously installed casing or parent casing string. The liner is typically secured to the parent casing string by a liner hanger that is coupled to the liner and engages with the interior of the upper casing or liner. It should be noted that, in some operations, a liner may extend from a previously installed liner or parent liner. Further, as with casing, a liner may be cemented into the well (e.g., over a desired interval). In other applications, the liner may not be cemented into the well.

In certain applications, slots may be formed in a tubular (e.g., casing or liner) before the tubular is run downhole (e.g., at the surface). For example, the slots may be formed in the tubular using rotary saws or other cutting tools. As will be appreciated, slotted tubulars may be used in applications where "heavy oil" (e.g., oil containing sand or other sediments) is extracted from a well formation, as well as other applications. It is now recognized that it may be beneficial to form slots in a tubular after the tubular is run downhole into the wellbore.

BRIEF DESCRIPTION

In a first embodiment, a system includes a downhole slot cutter, a housing of the downhole slot cutter configured to be inserted into a tubular positioned within a wellbore, and a plurality of dies supported by the housing, wherein the plurality of dies is configured to extend radially outward from the housing.

In a second embodiment, a system includes a downhole slot cutter, a housing of the downhole slot cutter configured to be inserted into a tubular within a wellbore, a plurality of dies supported by the housing, wherein the plurality of dies is configured to extend radially outward from the housing, and a mandrel configured to extend into the housing and behind the plurality of dies, wherein the mandrel comprises a sloped outer surface such that translation of the mandrel along a central axis of the housing forces the plurality of dies radially outward.

In a third embodiment, a method includes positioning a tubular within a wellbore, positioning a slot cutter within the tubular, translating a mandrel with respect to a housing of the slot cutter, and forcing a plurality of dies radially outward from the housing and into the tubular with the mandrel.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

The present disclosure relates generally to the cutting of slots in a down-hole component, such as a liner, when the down-hole component is positioned within a wellbore. More specifically, certain embodiments of the present disclosure are directed to providing and using a slot cutter to cut slots in tubular, such as casing, liners, and so forth when the tubular is positioned downhole.

In one implementation of the present disclosure, a slot cutter includes a body or housing (e.g., an annular body), which may be disposed within the tubular, that supports a plurality of dies configured to extend radially outward from the body or housing. In operation, a mandrel may be driven into a central opening of the body or housing, thereby forcing the plurality of dies radially outward. As the plurality of dies extend radially outward, each die may contact and puncture an inner surface of a casing, liner, or other tubular, thereby creating a slot or other opening in the casing, liner, or other tubular. In certain embodiments, the mandrel may be driven into the housing or body by a hydraulic force generated by a pump, a hydraulic pressure intensifier, a hydraulic cylinder, or a combination thereof.

After the slots are formed in the tubular, the force (e.g., pressure) actuating the mandrel may be released, thereby enabling the dies to retract into the body or housing. Thereafter, the slot cutter may be re-positioned in another location for slot cutting within the wellbore or may be removed from the wellbore. In this manner, slots or openings may be formed in a casing, liner, or other tubular after the casing, liner, or other tubular is positioned and landed in a wellbore. For example, embodiments of the present disclosure may enable optimization of slot cutting, production enhancement, improved tubular strength, and/or avoidance of undesirable slot locations within the wellbore. Furthermore, the disclosed embodiments may be used for well servicing applications, "re-slotting" existing liners, casings, or tubular, remediating plugged slots, and so forth.

Figure 1:
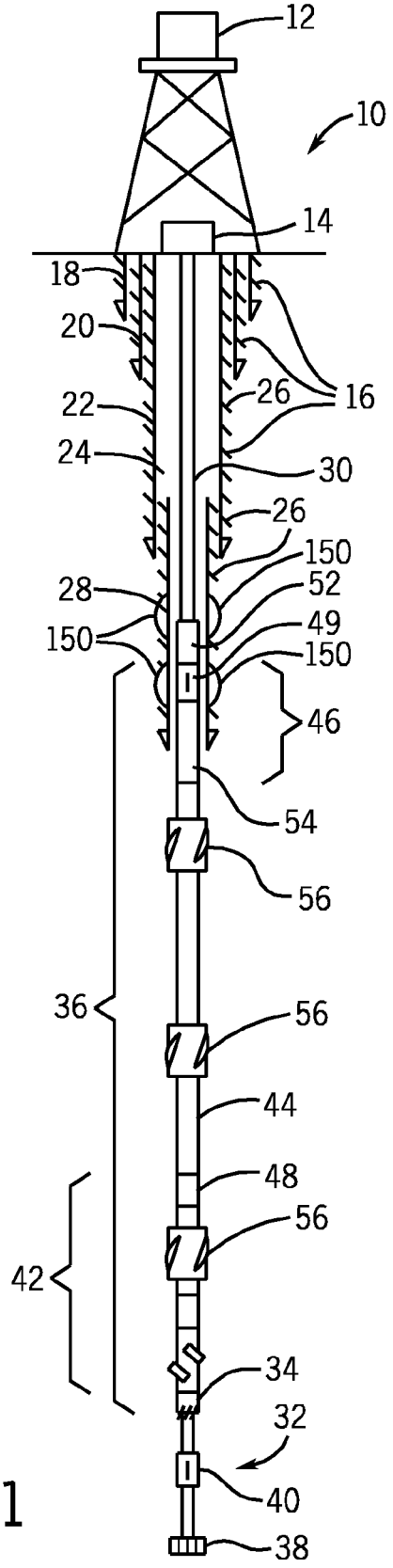
FIG. 1 is a schematic representation of a well being drilled, in accordance with aspects of the present disclosure.

Turning now to the drawings, FIG. 1 is a schematic representation of a well 10 including a tubular (e.g., casing or liner) which may have slots cut therein after the tubular is disposed within or down the well 10 in accordance the present embodiments. In the illustrated embodiment, the well 10 includes a derrick 12, wellhead equipment 14, and several levels of casing 16 (e.g., pipe). For example, the well 10 includes a conductor casing 18, a surface casing 20, and an intermediate casing 22. In certain embodiments, the casing 16 may include 30 foot segments of oilfield pipe having a suitable diameter (e.g., 13⅜ inches) that are joined as the casing 16 is lowered into a wellbore 24 of the well 10. As will be appreciated, in other embodiments, the length and/or diameter of segments of the casing 16 may be other lengths and/or diameters. The casing 16 is configured to isolate and/or protect the wellbore 24 from the surrounding subterranean environment. For example, the casing 16 may isolate the interior of the wellbore 24 from fresh water, salt water, or other minerals surrounding the wellbore 24.

The casing 16 may be lowered into the wellbore 24 with a running tool. As shown, once each level of casing 16 is lowered into the wellbore 24 of the well, the casing 16 is secured or cemented in place with cement 26. For example, the cement 26 may be pumped into the wellbore 24 after each level of casing 16 is landed in place within the wellbore 24. Furthermore, the well 10 may include a liner 28 disposed within the wellbore 24 and the casing 16 (e.g., the intermediate casing 22) and held in place by cement 26. Specifically, the liner 28 may be hung from the casing 16 (e.g., the intermediate casing 22) within the wellbore 24. With the levels of casing 16 and the liner 28 in place, a slot cutter (e.g., slot cutter 100 shown in FIG. 2) may be run into the wellbore 24 (e.g., using a drill pipe 30) and used to form slots 150 in the casing 16 or liner 28, as described in detail below.

After slots are formed in the casing 16 or liner 28, the drill pipe 30 and a drilling BHA 32 may be reintroduced or continue into the wellbore 24 for operation. For example, the drill pipe 30 and the drilling BHA 32 may complete a drilling process within the wellbore 24. In certain embodiments, the drilling BHA 32 may include a variety of tools that are used to complete the drilling process. In the illustrated embodiment, the BHA 32 includes a liner shoe 34 at the bottom of a liner string 36. Additionally, the BHA 32 includes a drill bit 38 and an under reamer 40. Specifically, in the illustrated embodiment, the drill bit 38 and the under reamer 40 of the drilling BHA 32 extend out from the liner string 36. Thus, the drilling BHA 32 is positioned to initiate and guide the drilling process.

The liner string 36 further includes a shoe track 42, a string of tubing 44, and a liner top assembly 46. The shoe track 42 defines the bottom of the liner string 36 and includes the liner shoe 34 to facilitate guiding the liner string 36 through the wellbore. In the illustrated embodiment, the shoe track 42 also includes an indicator landing sub 48 to facilitate proper engagement with the drilling BHA 32, and various other features, such as a pump down displacement plug (PDDP). The string of tubing 44 is essentially the main body of the liner string 36 that connects the shoe track 42 with the liner top assembly 46. The liner top assembly 46, which defines the top of the liner string 36, includes a liner hanger 49 that is capable of being activated and/or deactivated by a liner hanger control tool 52. The liner top assembly 46 may also include a liner drill lock section 54, which includes a liner drill lock that facilitates engagement/disengagement of the drill string 30 from the liner string 36. The liner drill lock may be actuated by external or internal components affixed to or part of a body of the liner hanger 49. As shown, the liner string 36 further includes centralizing elements 56, which generally keep tubular elements centered within the wellbore 24 when deployed and operated (e.g., rotated).

Figure 2:
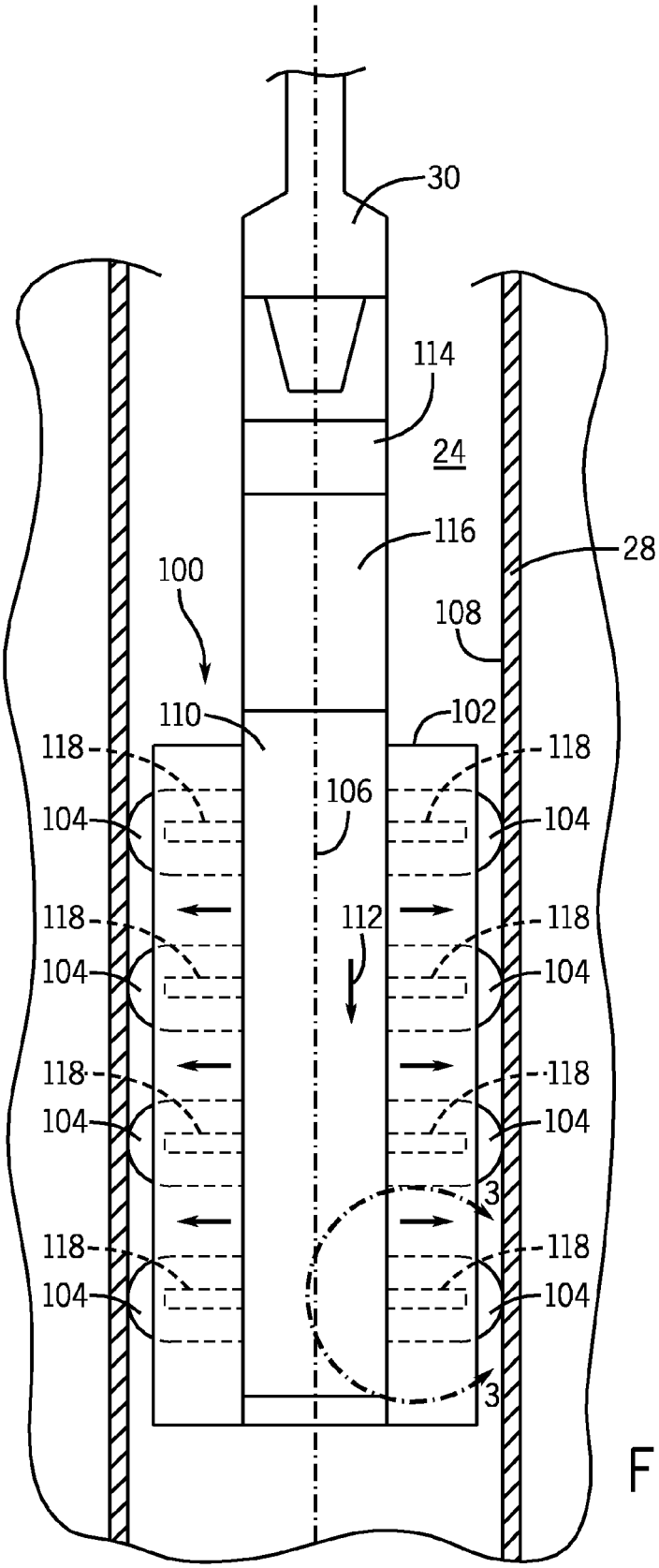
FIG. 2 is a schematic representation of a slot cutter within a wellbore, in accordance with aspects of the present disclosure.

FIG. 2 is a schematic illustrating a slot cutter 100 positioned within the liner 28 landed in the wellbore 24. As mentioned above, the slot cutter 100 is configured to form slots in a tubular, such as the casing 16, liner 28, or other tubular positioned within the wellbore 24. In the illustrated embodiment, the slot cutter 100 has a main body 102, which supports a plurality of dies 104. In certain embodiments, the main body 102 may be an annular or cylindrical housing. The plurality of dies 104 extends radially outward from a central axis 106 of the slot cutter 100. In this manner, the plurality of dies 104 may contact an inner surface 108 of the liner 28 when the plurality of dies 104 are forced radially outward during operation of the slot cutter 100.

The slot cutter 100 is positioned within the liner 28 using the drill pipe 30. However, in other embodiments, the slot cutter 100 may be positioned using coiled tubing or other tools. During operation, the plurality of dies 104 may be forced radially outward by a mandrel 110. The mandrel 110 may include a surface (e.g., an angled surface) that is configured to act on the main body 102 and/or the plurality of dies 104. For example, the mandrel 110 may be a frustum. In operation, the mandrel 110 may be displaced axially, e.g., in a direction 112, by a hydraulic force generated by a pump located at the surface of the well 10. For example, the pump may use mud, cement, or other well servicing fluid as the working fluid. The working fluid may be supplied to a hydraulic pressure intensifier 114 within the wellbore 24, which subsequently feeds a high hydraulic pressure to a hydraulic cylinder 116 that displaces the mandrel 110 in the direction 112. In other embodiments, the mandrel 110 and/or the dies 104 may be actuated mechanically. For example, the inner diameter (e.g., inner surface 108) of the liner 28 (or casing) may be gripped and pulled with draw works of the derrick 12, which may be connected to the mandrel 110 and/or slot cutter 100 (e.g., dies 104) by the drill pipe 30. In other embodiments, a combination of hydraulic and mechanical mechanisms may be used to actuate the mandrel 110 and/or force the dies 104 radially outward. As the mandrel 110 is displaced in the direction 112, the mandrel 110 forces the plurality of dies 104 radially outward, in the manner described below.

Furthermore, as the plurality of dies 104 is forced radially outward by the mandrel 110, die guides 118 of each of the plurality of dies 104 help keep the plurality of dies 104 level with respect to the mandrel 110 as the dies 104 move radially outward. Specifically, each of the dies 104 and its die guides 118 are supported in a respective opening (e.g., opening 200 shown in FIG. 5) of the main body 102. As the dies 104 extend radially outward, a cutting portion or blade (e.g., cutting portion 158 shown in FIG. 4) of each die 104 contacts and pierces the inner surface 108 of the liner 28, thereby forming a slot in the liner 28.

Figure 3:
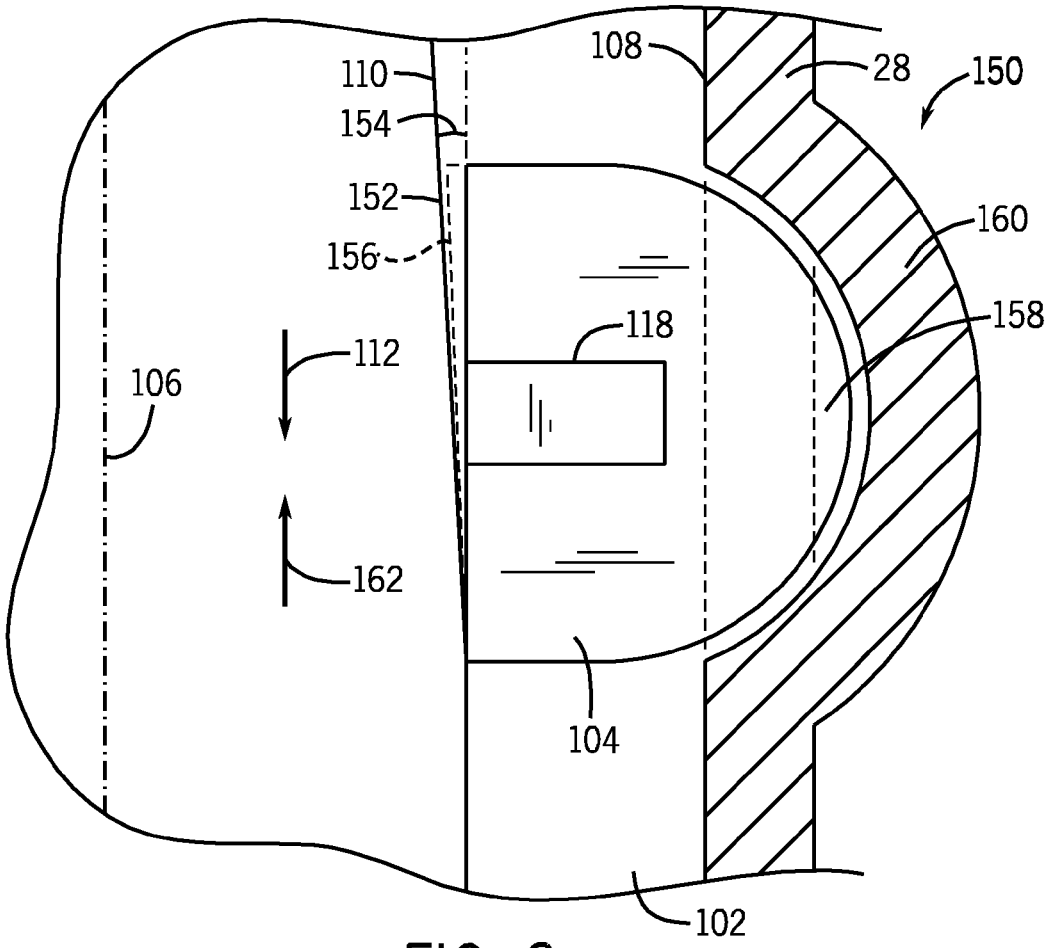
FIG. 3 is a schematic side view of an embodiment of a slot cutter, in accordance with aspects of the present disclosure.

FIG. 3 is a partial schematic side view of an embodiment of the slot cutter 100, illustrating one of the dies 104 forming a slot 150 in the liner 28. As mentioned above, the mandrel 110 of the slot cutter 100 is axially displaced by hydraulic pressure, which may be generated by a pump, the hydraulic pressure intensifier 114, the hydraulic cylinder 116, or a combination thereof. As the mandrel 110 is axially displaced in the direction 112, the mandrel 110 forces the die 104 radially outward. In particular, the mandrel 110 has an angled surface 152, which facilitates the radial movement of the die 104. In the illustrated embodiment, the angled surface 152 of the mandrel 110 forms an angle 154 relative to the central axis 106 of the main body 102 of the slot cutter 100. In certain embodiments, a rear surface 156 of the die 104 may also be angled, such that the rear surface 156 of the die 104 and the mandrel 110 substantially completely abut one another.

As the mandrel 110 is displaced in the direction 112 and causes the die 104 to move radially outward, a cutting portion 158 (e.g., a blade) of the die 104 contacts and pierces the inner surface 108 of the liner 28, thereby forming the slot 150. More specifically, the cutting portion 158 (e.g., blade) of the die 104 perforates a piece or "slice" 160 of the liner 28 to form the slot 150. In this manner, an opening (e.g., opening 220 shown in FIG. 6) is created between an interior of the liner 28 and an exterior of the liner 28 enabling sand or other sediments and materials to be filtered out from a production fluid being pumped from the well 10.

After the slot 150 is formed, the hydraulic pressure used to displace the mandrel 110 may be released. As the hydraulic pressure is released, the mandrel 110 may be displaced in a direction 162, thereby allowing the die 104 to retract (e.g., radially inward) back into the main body 102 of the slot cutter 100. For example, the dies 104 may retract due to formation pressure within the well 10. Additionally, the slot cutter 100 may include other mechanisms to enable retraction of the dies 104, such as springs or other biasing mechanisms. With the hydraulic pressure released, the slot cutter 100 may then be relocated within the liner 28 and wellbore 24 by the drill pipe 30 to create more slots 150 in other portions of the liner 28, or the slot cutter 100 may be removed from the wellbore 24.

Figure 4:
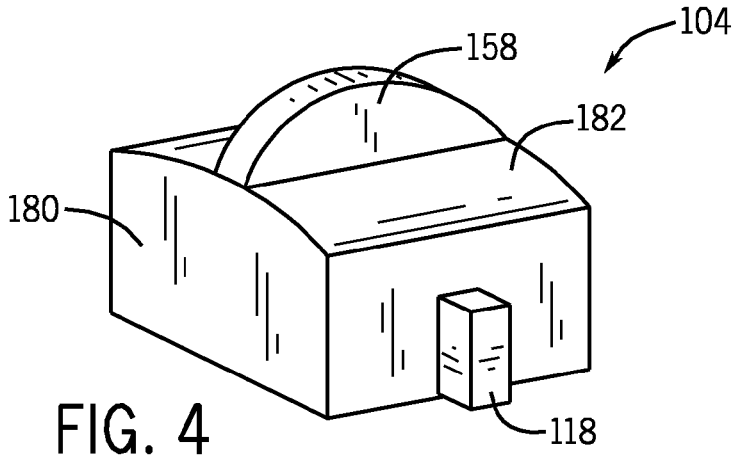
FIG. 4 is a perspective view of an embodiment of a slot die, in accordance with aspects of the present disclosure.

FIG. 4 is a perspective view of an embodiment of one of the dies 104 that may be supported by the main body 102 of the slot cutter 100. In the illustrated embodiment, the die 104 has a main portion 180 that is housed within the main body 102 of the slot cutter 100. Additionally, the die guides 118 of the die 104 extend laterally from the main portion 180. The cutting portion 158 (e.g., blade) also extends laterally from the main portion 180. Specifically, as mentioned above, the cutting portion 158 extends laterally from an outer-facing surface 182 of the die 104. In other words, the outer-facing surface 182 faces radially outward when the die 104 is positioned within the main body 102.

Moreover, while the illustrated embodiment shows the cutting portion 158 (e.g., blade) having an arcuate or curved shape, other embodiments may have other configurations or shapes. For example, the cutting portion 158 may be triangular, polygonal, or other shape suitable for piercing the liner 28 to form the slot 150. Additionally, other configurations may include two or more cutting portions 158 extending from the main portion 180 and/or other numbers of die guides 118 extending from the main portion 180.

Figure 5:
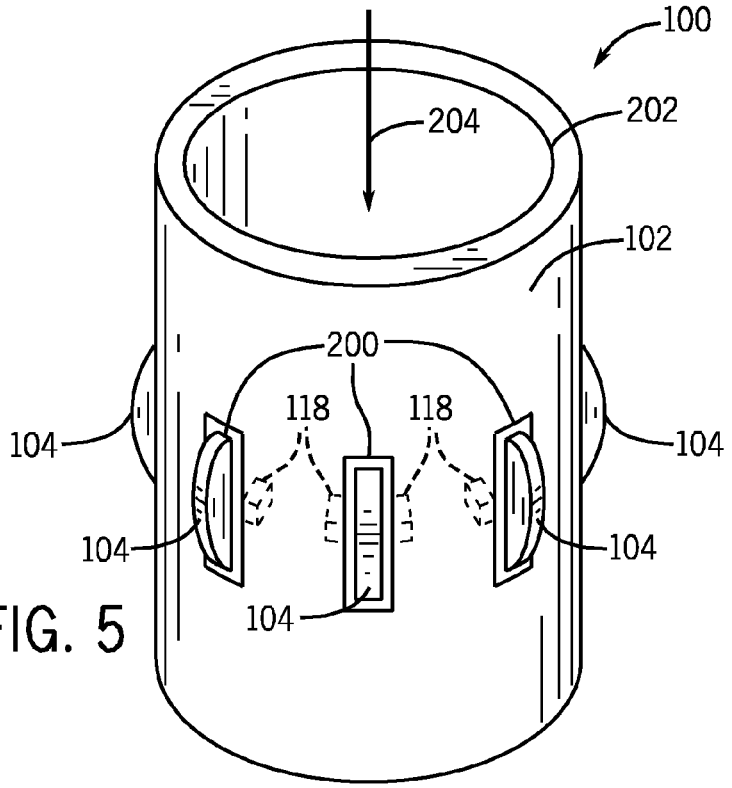
FIG. 5 is a perspective view of an embodiment of a slot cutter having a plurality of slot dies supported by a housing, in accordance with aspects of the present disclosure.

FIG. 5 is a perspective view of an embodiment of the slot cutter 100 in a partially actuated stage of operation. As described above, the plurality of dies 104 extends radially outward from the main body 102 of the slot cutter 100. Specifically, each die 104 extends radially outward through a respective opening 200 formed in the main body 102 of the slot cutter 100. In the illustrated embodiments, the openings 200 and respective dies 104 are spaced substantially equidistantly about a circumference 202 of the main body 102. However, in other embodiments, the openings 200 and dies 104 may be spaced in a staggered, offset, tiered, or other arrangement. Furthermore, the illustrated dies 104 are oriented vertically relative to the central axis 106 of the main body 102, however, in other embodiments the dies 104 may have a horizontal or angled orientation. In yet other embodiments, the orientation of the dies 104 (e.g., cutting portions 158) may vary. That is, some dies 104 may have a first orientation (e.g., vertical), other dies 104 may have a second orientation (e.g., horizontal), and so forth.

As described above, the slot cutter 100 is operated by axially displacing the mandrel 110 within the main body 102 of the slot cutter 100, thereby driving the dies 104 radially outward. While the mandrel 110 is not shown in the illustrated embodiment for clarity, arrow 204 illustrates the manner in which the mandrel 110 is inserted into and translated within the main body 102 of the slot cutter 100. Furthermore, while the embodiments described above include the use of a pump, the hydraulic intensifier 114, and/or the hydraulic cylinder 116, other embodiments may include the use of other systems to facilitate the formation of the slots 150 in the liner 28 when the liner 28 is positioned within the wellbore 24. For example, certain embodiments may include an internal casing drive tool or other tool configured to introduce localized stress concentrations in the liner 28, thereby reducing the force required to drive the dies 104.

Figure 6:
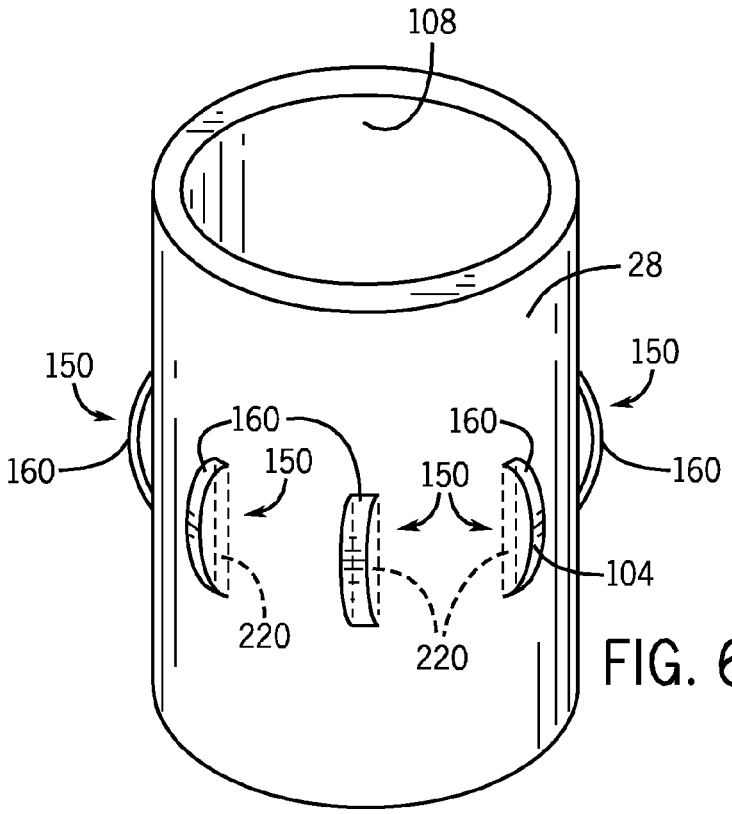
FIG. 6 is a perspective view of an embodiment of a tubular with slots formed therein, in accordance with aspects of the present disclosure.

FIG. 6 is a perspective view of the liner 28 having slots 150 formed therein by the slot cutter 100 shown in FIG. 5. As described in detail above, the slots 150 are formed when the dies 104 puncture the liner 28. More specifically, the dies 104 perforate the liner to form pieces or "slices" 160 of the slots 150. As a result, openings 220 are formed in the liner 28, which enables the filtering of sand, sediments, or other particles from production fluid as production fluid is pumped from the well 10.

As discussed in detail above, embodiments of the present disclosure include the slot cutter 100 which is configured to form slots 150 in a down-hole component, such as the liner 28, when the down-hole component is positioned within the wellbore 24. The slot cutter 100 includes the main body 102 (e.g., an annular body), that supports the plurality of dies 104 that are configured to extend radially outward from the main body 102. In operation, the mandrel 110 is driven into a central opening of the main body 102, thereby forcing the plurality of dies 104 radially outward. As the plurality of dies 104 extend radially outward, each die 104 contacts and perforates the inner surface 108 the liner 28 (or other tubular), thereby creating the slot 150 in the liner 28. For example, the mandrel 110 may be axially displaced in the main body 102 by a hydraulic force generated by a pump, the hydraulic intensifier 114, the hydraulic cylinder 116, or a combination thereof. After the slots 150 are formed in the liner 28 or other tubular, the pressure may be released, thereby enabling the dies 104 to retract into the main body 102. Thereafter, the slot cutter 100 may be re-positioned in another location for slot cutting within the liner 28 or other tubular. Alternatively, the slot cutter 100 may be removed from the wellbore 24. In this manner, the slots 150 may be formed in the liner 28 after the liner 28 is positioned within the wellbore 24. As a result, liner 28 strength may be improved, slot 150 location within the wellbore 24 may be more accurate, down-hole liners 28 may be re-slotted, and so forth.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system, comprising:

a downhole slot cutter;

a housing of the downhole slot cutter configured to be inserted into a tubular positioned within a wellbore; and a plurality of dies supported by the housing, wherein the plurality of dies is configured to extend radially outward from the housing, and each of the plurality of dies comprises a cutting portion having a smooth, semi-circular outer radial surface and a substantially constant width, wherein the substantially constant width is generally perpendicular to a central axis of the downhole slot cutter.

2. The system of claim 1, wherein the plurality of dies comprises a plurality of arcuate disks.

3. The system of claim 1, wherein the plurality of dies is spaced equidistantly about the housing.

4. The system of claim 1, wherein the housing is substantially annular and is configured to receive a mandrel of a downhole tool such that translation of the mandrel along the central axis of the downhole slot cutter actuates the plurality of dies.

5. The system of claim 4, comprising a hydraulic system configured to actuate the mandrel.

6. The system of claim 5, wherein the hydraulic system comprises a pump, a hydraulic intensifier, a hydraulic cylinder, or a combination thereof.

7. The system of claim 1, wherein each of the plurality of dies comprises a geometry configured to puncture an inner surface of the tubular.

8. The system of claim 1, wherein each of the plurality of dies comprises:

a main portion, wherein the cutting portion extends radially outward from the main portion relative to the central axis of the downhole slot cutter; and a plurality of die guides extending circumferentially outward from the main portion relative to the central axis of the downhole slot cutter, wherein the plurality of die guides is configured to guide the respective die radially outward and level relative to the central axis of the downhole slot cutter.

9. The system of claim 1, wherein at least one of the plurality of dies comprises a corresponding cutting portion oriented vertically relative to the central axis of the downhole slot cutter.

10. A system, comprising:

a downhole slot cutter;

a housing of the downhole slot cutter configured to be inserted into a tubular within a wellbore;

a plurality of dies supported by the housing, wherein the plurality of dies is configured to extend radially outward from the housing, wherein each of the plurality of dies comprises a cutting portion having a smooth, semi-circular outer radial surface and a substantially constant width, wherein the substantially constant width is generally perpendicular to a central axis of the housing; and a mandrel configured to extend into the housing and behind the plurality of dies, wherein the mandrel comprises a sloped outer surface such that translation of the mandrel along the central axis of the housing forces the plurality of dies radially outward.

11. The system of claim 10, comprising a hydraulic system configured to axially displace the mandrel with a hydraulic pressure.

12. The system of claim 11, wherein the hydraulic system comprises a pump, a hydraulic intensifier, a hydraulic cylinder, or a combination thereof.

13. The system of claim 10, wherein the cutting portion of each of the plurality of dies extends radially outward from a respective opening in the housing.

14. The system of claim 13, wherein each of the plurality of dies comprises:

a main portion, wherein the cutting portion extends radially outward from the main portion relative to the central axis of the housing; and a plurality of die guides extending circumferentially outward from the main portion relative to the central axis of the housing, wherein the plurality of die guides is configured to guide the respective die radially outward and level relative to the central axis of the housing.

15. The system of claim 13, wherein the cutting portion of each of the plurality of dies is oriented vertically relative to the central axis of the housing.

16. The system of claim 10, wherein the mandrel is a frustum.

17. A method, comprising:

positioning a tubular within a wellbore;

positioning a slot cutter within the tubular after the tubular is positioned within the wellbore;

translating a mandrel with respect to a housing of the slot cutter; and forcing a plurality of dies radially outward from the housing and into the tubular with the mandrel to puncture the tubular and create a plurality of slices of the tubular, wherein each of the plurality of slices is attached to a main body of the tubular at respective axial ends of each of the plurality of slices, and each of the plurality of slices defines openings on either side of the respective slice.

18. The method of claim 17, wherein forcing the plurality of dies into the tubular with the mandrel comprises puncturing the tubular with a cutting portion of each of the plurality of dies having a smooth, semi-circular outer radial surface, wherein the cutting portion comprises a substantially constant width, and wherein the substantially constant width is generally perpendicular to a central axis of the slot cutter.

19. The method of claim 17, wherein forcing the plurality of dies radially outward from the housing and into the tubular with the mandrel comprises axially displacing the mandrel with a pressurized hydraulic fluid.

* * * * *